US006823709B2

(12) United States Patent
Dowell et al.

(10) Patent No.: US 6,823,709 B2
(45) Date of Patent: Nov. 30, 2004

(54) SYNCHRONIZED RIVET GUN SYSTEM

(75) Inventors: David H. Dowell, Redwood City, CA (US); Philip E. Johnson, Auburn, WA (US); Frederic P. Berg, Seattle, WA (US); George A. Perry, Federal Way, WA (US)

(73) Assignee: The Boeing Company, Chicago, IL (US)

( * ) Notice: Subject to any disclaimer, the term of this patent is extended or adjusted under 35 U.S.C. 154(b) by 307 days.

(21) Appl. No.: 10/214,049

(22) Filed: Aug. 6, 2002

(65) Prior Publication Data

US 2004/0025313 A1 Feb. 12, 2004

(51) Int. Cl.[7] ..... B21J 15/24; H02K 33/00

(52) U.S. Cl. ..... 72/430; 72/54; 29/243.53; 29/715

(58) Field of Search ..... 72/430, 54; 29/715, 29/243.53, 243.54

(56) References Cited

U.S. PATENT DOCUMENTS 3,559,269 A 2/1971 Schmitt et al.
3,704,506 A 12/1972 Orr et al.
4,862,043 A * 8/1989 Zieve ..... 72/430
5,398,537 A * 3/1995 Michalewski et al. ..... 72/430
5,471,865 A * 12/1995 Michalewski et al. ..... 72/430
5,813,110 A 9/1998 Arntson et al.
6,014,804 A * 1/2000 Lulay et al. ..... 29/715
6,446,319 B1 * 9/2002 Lulay et al. ..... 29/407.08

FOREIGN PATENT DOCUMENTS

EP 0 545 638 A1 6/1993

* cited by examiner

*Primary Examiner*—David Jones
(74) *Attorney, Agent, or Firm*—Artz & Artz, PC

(57) ABSTRACT

A rivet gun system includes a rivet gun frame having two ends. A die is coupled to one end, and a force sensor coupled to the rivet gun frame. The force sensor detects force applied to the die and generates a force signal in response to the force. A holding coil defines a channel within the rivet gun frame and generates an electromagnetic force along the channel. The channel includes an end defined by an end stop and an end defined by the die. A main coil further defines the channel between the holding coil and the die. The main coil also generates an electromagnetic force along the channel. A plunger slides through the channel in response to the electromagnetic forces. A force sensor electronics controller receives the force signal from the force sensor and activates the holding coil and the main coil in response to the force signal above an activation threshold.

20 Claims, 7 Drawing Sheets

SYNCHRONIZED RIVET GUN SYSTEM

TECHNICAL FIELD

The present invention relates generally to rivet guns, and more particularly, to a system and method for synchronizing two rivet guns.

BACKGROUND ART

Current rivet forming methods include squeeze riveting, electromagnetic riveting, and pneumatic riveting. These riveting methods require considerable worker skill to accurately set rivets and avoid damage to airplane skin.

One of the aforementioned common rivet forming processes is squeeze riveting, which is not an impact forming process. This process uses an actuator (either hydraulic or pneumatic) to slowly apply two opposing (balanced) forces to the rivet. Noise and hand-arm vibration levels are not generated. This process is limited, however, because it requires a rigid steel frame to reach around the part and react against the high rivet compressive forces. For example, the process cannot be used when joining airplane body sections because the necessary gun frame would have to extend around twenty foot long sections.

Another common rivet forming process is electromagnetic riveting (EMR), which delivers a single application of two synchronized opposing impact forces to the rivet. This process generates an impact force by discharging a charged capacitor into a flat faced coil located in a hand held gun. The coil induces eddy currents in an adjacent copper faced mass driver that generates an opposing magnetic force to repel the mass driver into the rivet. Since the mass driver travels over a short distance in a relatively short amount of time, it generates a high reactionary (or recoil) force. For example, the kinetic energy equation is $E=0.5\ mv^2$, and the recoil force relationship is $F=d(mv)/dt$, so for constant energy, the force relationship indicates that a short impact time generates high recoil forces.

One of the only current ways to reduce the EMR recoil force is to add mass to the gun. For instance, an EMR model HH500, from Electroimpact weighs approximately 175 lbs. The EMR guns must be supported from above by a force counterbalance mechanism or supported below by a support platform. These supports make the EMR cumbersome to use, expensive, and they limit useful applications thereof.

Still another common rivet forming process is pneumatic impact riveting. To form a rivet through pneumatic riveting, an impact force is directed to the head of the rivet. The reactionary force is applied by an operator using a bucking bar. Since the operator cannot apply an equivalent opposing force, the impact forces are imbalanced and both structure and bucking bar move in response thereto. The displacement generates motion and initiates structural bending waves that propagate throughout the structure, radiating noise energy. The bucking bar displacement (and motion) results in high acceleration levels. Since multiple impacts are required to form a rivet, these motion effects are multiplied by the impact frequency.

Resultantly, pneumatic impact riveting generates noise ranging from 110 dBA to 130 dBA and generates bucking bar vibration levels in excess of 1000 $m/s^2$. These repeated mechanical shocks are often injurious to the worker, resulting in hearing loss and more serious long-term damage to the circulation and nervous system.

The disadvantages associated with current riveting techniques have made it apparent that a new riveting technique is needed. The new technique should substantially reduce noise and impact vibrations without significantly increasing rivet gun size or weight. The present invention is directed to these ends.

SUMMARY OF THE INVENTION

The present invention provides a rivet gun system. The present invention also provides a system for synchronizing two rivet guns.

In accordance with one aspect of the present invention, a rivet gun system, which includes a rivet gun frame having a first end and a second end, is disclosed. A die is coupled to the first end, and a force sensor coupled to the rivet gun frame. The force sensor is adapted to detect a force applied to the die and is further adapted to generate a force signal in response to the force. A holding coil defines a channel within the rivet gun frame. The holding coil is adapted to generate a first electromagnetic force along the channel. The channel includes a first end defined by an end stop and a second end defined by the die. A main coil further defines the channel between the holding coil and the die. The main coil is adapted to generate a second electromagnetic force along the channel. A first plunger is adapted to slide through the channel. A force sensor electronics controller is adapted to receive the force signal and is further adapted to activate the holding coil and the main coil in response to the force signal above a threshold.

In accordance with another aspect of the present invention, a method for riveting including applying a first force to a first side of a compressible object from a first rivet gun and aligning a second rivet gun with the first rivet gun on a second side of the compressible object is disclosed. A second force is applied from the second rivet gun to the second side, and a signal is generated when the first force and the second force are adequate. The first rivet gun is then signaled that the second rivet gun is activated and triggered in response to this signal. The first rivet gun and the second rivet gun are then synchronized and the compressible object is impacted by the rivet gun dies.

An advantage of the present invention is that it includes a verification system to notify rivet gun operators that sufficient pressure has been applied thereto for counteractive force operation. Another advantage of the present invention is the use of optical sensors for synchronization of the two plungers, which ensures that they will impact the rivet at substantially the same time. Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

DETAILED DESCRIPTION OF THE INVENTION

The present invention is illustrated with respect to a synchronized hand-held rivet gun system, particularly suited to the aeronautical field. The present invention is, however, applicable to various other uses that may require rivet guns, as will be understood by one skilled in the art.

Figure 1:
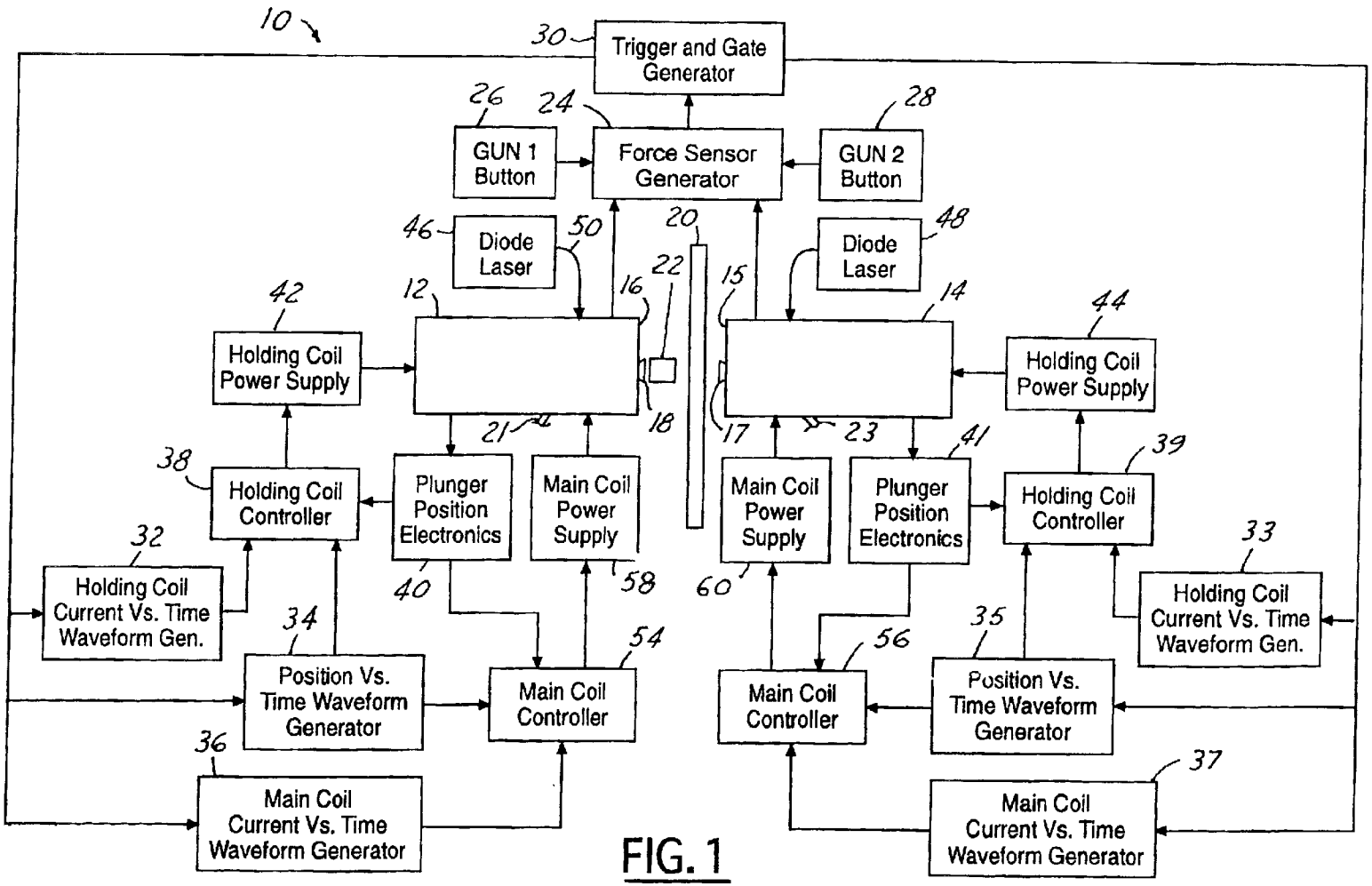
FIG. 1 is a block diagram of a synchronized rivet gun control system in accordance with one embodiment of the present invention.

Referring to FIG. 1, a block diagram of a synchronized rivet gun control system 10, in accordance with the present invention, is illustrated. The system 10 includes at least two lightweight (e.g. less than 10 pounds) electromagnetic rivet guns 12, 14.

The system includes a first rivet gun 12 having a face 16 (second end) and a first die 18 disposed thereon. The system 10 further includes a second rivet gun 14 (also including a face 15 and a second die 17 disposed thereon) substantially identical to the first rivet gun 12. The two rivet guns 12, 14 are illustrated facing each other, and a sheet of metal 20, such as an airplane wing, is illustrated between the rivet guns 12, 14.

Furthermore, A rivet 22 or other compressible object is illustrated between the first rivet gun 12 and the sheet of metal 20 prior to impact. Each rivet gun includes major components such as: holding coils, main coils, magnetic plungers, rivet die, and force sensors 21, 23, operator signal devices 25, 27 all of which will be discussed later.

The two rivet guns 12, 14 are coupled together through a force sensor electronics controller 24. A first gun activation button 26 and a second gun activation button 28 are coupled to the force sensor electronics controller 24 and the respective rivet guns 12, 14. A Trigger and Gate Generator 30 is also coupled to the force sensor electronics controller 24, the Generator 30 sends signals to various waveform generators such as the Holding Coil Current Versus Time waveform generators 36, 37, the Position Versus Time waveform generators 34, 35, and the Main Coil Current Versus Time waveform generators 36, 37, the functions of which will be discussed later.

Holding coil controllers 38, 39 are electrically coupled to the Holding Coil Current Versus Time waveform generators 32, 33, the Position Versus Time waveform generators 34, 35, Plunger Position Electronics 40, 41, and holding coil power supplies 42, 44. The holding coil power supplies 42, 44 and the Plunger Position Electronics 40, 41 are electrically coupled to the rivet guns 12, 14. Diode lasers 46, 48 are also coupled to the rivet guns 12, 14 through transmission optical fibers 50, 52 (optical sensors). Main coil controllers 54, 56 are electrically coupled to the Position Versus Time waveform generators 34, 35, the Main Coil Current Versus Time generators 36, 37, the Plunger Position Electronics 40, 41, and the main coil power supplies 58, 60, which are coupled to the rivet guns 12, 14.

Figure 2:
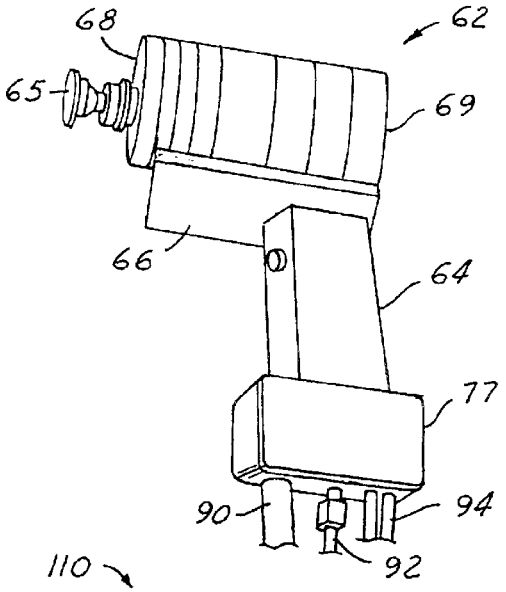
FIG. 2 illustrates a perspective view of a synchronized, multi-impact rivet gun in accordance with another embodiment of the present invention.
Figure 3:
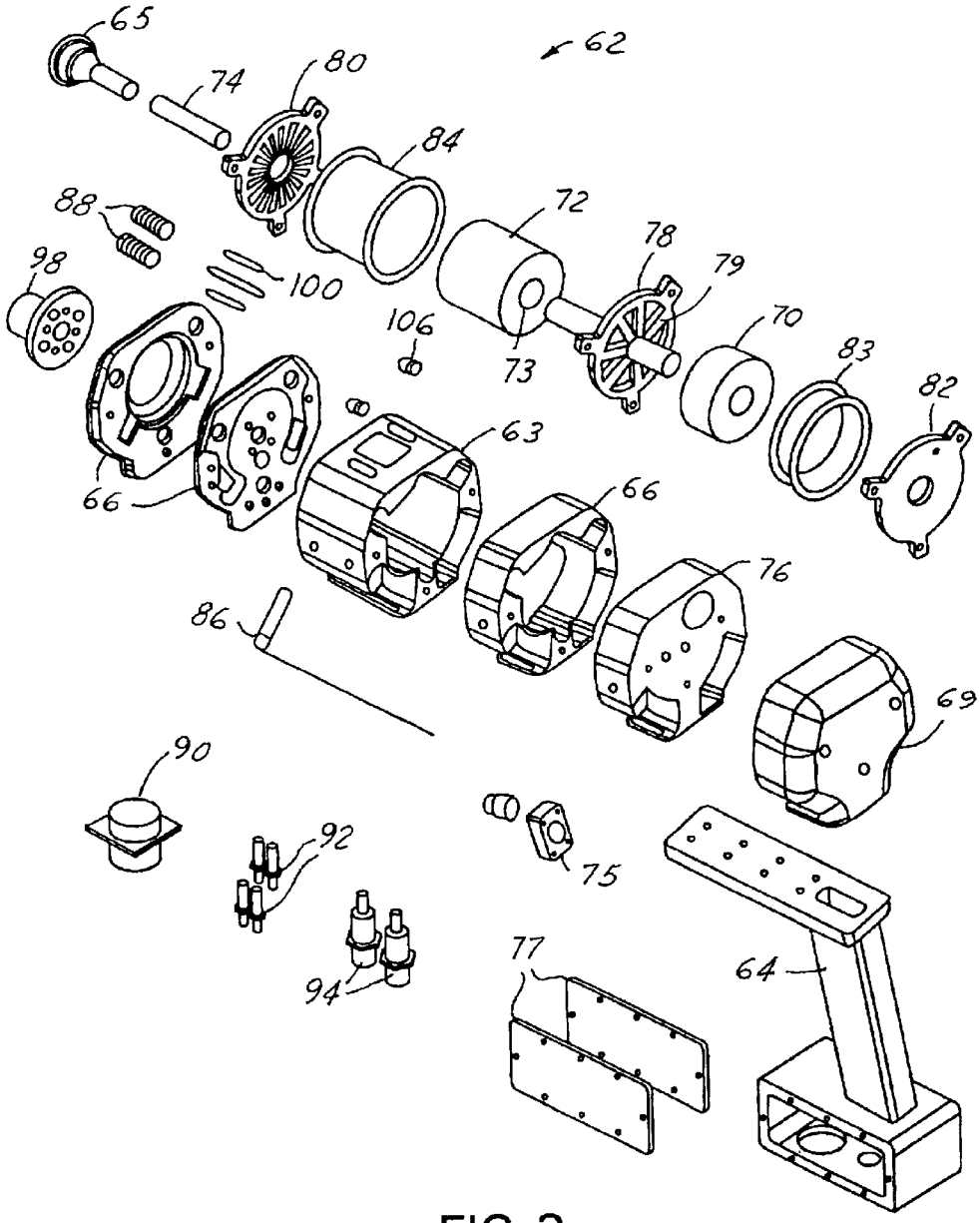
FIG. 3 illustrates an exploded view of the synchronized, multi-impact rivet gun of FIG. 2.

Referring to FIGS. 2 and 3, a synchronized, multi-impact rivet gun 62 including a handle 64 coupled to a section of various housing components 66 (rivet gun frame), is illustrated. The housing components 66 include a second end 68, which has a die 65 moveably coupled thereto, and a first end 69 of a cylindrical or rectangular housing 66. The housing components surround at least two concentric pulsed electromagnetic coils 70, 72, which define a channel 73, which in turn surrounds the plunger 74. The second rivet gun includes a substantially similar plunger, therefore, description of the plunger 74 will apply to both rivet guns.

The embodied handle 64 includes an activation trigger 75. Plates 77 were added to the base of the embodied handle 64 as access ports to the handle 64, as will be understood by one skilled in the art.

The die 65 is held in place by a die holder 98, which is aligned with the second end 68 through a plurality of alignment puns 100.

Also attached to the housing 66 are an electrical socket 90, a set of optical sensor sockets 92, and fluid sockets 94, which input connective cables to the gun 62 and allow for coupling of multiple rivet guns, as will be understood by one skilled in the art.

The holding coil 70 is positioned near the first end 69, and the main coil 72 is positioned near the second end 68. The plunger 74 moves through a substantially cylindrical tube (channel) defined by the coils 70, 72, a fiber holder 78, a front distribution plate 80, and a end distribution plate 82 and is stopped near the first end 69 by an end stop 76. The fiber holder 78, which separates the coils 70, 72 also holds optical fibers 79 (optical sensors), which allow the fiber optics to see the plunger 74, as will be discussed later. The die 65 is disposed at the second end 68 and moveably attached thereto. The holding coil 70 is surrounded by a holding coil coolant jacket 83, and the main coil 72 is surrounded by a main coil coolant jacket 84.

At least one force sensor 86 is coupled to the gun 12 such that the force sensor 12 receives a force signal from the die 65 (and die compression units 88) indicating that sufficient force is exerted on the die to allow firing of the rivet gun 12. The force sensor 86 or sensors on each gun are integrated into the mechanical design of the rivet gun 12, and the force sensor signals are used to verify that each operator is applying proper force to each gun prior to operation.

The magnetic coils 70, 72 accelerate the magnetic plunger 74 into the die 65, which sets the rivet. In each embodied gun 12, 14 there are two coils, which move the plunger 74 back and forth. The first is the holding coil 70, which pulls the plunger 74 backward from the die 65 and holds the plunger 74 against the end stop 76 before each impact. The second larger coil, the main coil 72, accelerates the plunger 74 from the end stop 76 into the die 65 to set the rivet.

The main coil 72 brakes the plunger 74 on the return stroke whereby the plunger 74 comes to rest against the end stop 76 without significant impact vibration. This 'soft return' innovation has two advantages. The first is elimination of mechanical shock to the operator during the return stroke. The second is that it allows the guns to operate faster, i.e. more impacts per second. Without 'soft return' control, the plunger will bounce between the end stop and die for several hundred milliseconds before coming to rest. With soft return control, the plunger does not bounce and comes to a rest within 40 milliseconds. This makes operating at 20 impacts per second possible.

The rivet gun 62 includes optical encoder technology, which will be discussed later, to measure the direction and position of the plunger 74 and use this information to independently control the gun 62 in order to impact both ends of the rivet simultaneously (within 5 microseconds) with substantially equal energy. The two guns ideally operate at 10 or more impacts per second, and set, for example, a 3/16 inch rivet (high strength alloy) in less than one second.

In addition to the high speed optical encoding and electronic control, the guns are fluid cooled to remove waste heat from the coils 70, 72. The cooling and electrical power through the main coil coolant jacket 84 and the holding coil coolant jacket 83 allow the setting of a rivet at approximately one per second and minimize desynchronization.

At least one operator signal device 106 (first operator signal device), here embodied as an LED, is coupled to the first rivet gun 62. The present embodiment includes at least two operator signal devices for each rivet gun. One to signal that both guns are ready and on to signal that the second gun has been triggered and is awaiting response from the first rivet gun 62.

Figure 4:
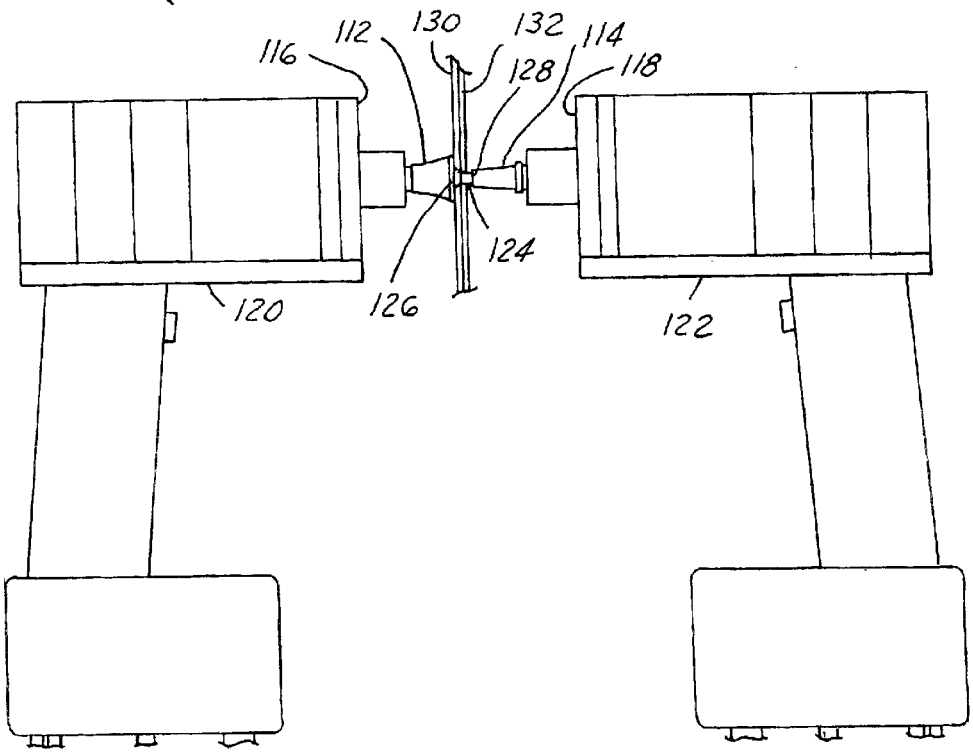
FIG. 4 illustrates a side view of the synchronized hand-held rivet gun system in operation in accordance with another embodiment of the present invention.

Referring to FIG. 4, a magnified view of the synchronized hand-held rivet gun system 110 illustrating die 112, 114 and second end portions 116, 118 of two rivet guns 120, 122 acting on a rivet 124 illustrated. Pressure is applied to the head 126 of the rivet 124 from the die 112 of the first rivet gun 120 and pressure is applied to the tail 128 of the rivet 124 by the die 114 of the second rivet gun 122. One skilled in the art will understand that numerous types of dies are alternately used in the present invention. The die 112 of the first rivet gun 120 is illustrated as a rivet die, and the die 114 of the second rivet gun 122 is illustrated as a bucking rivet die. The rivet is coupling two sheets of metal 130, 132 together, as will be understood by one skilled in the art.

Figure 5:
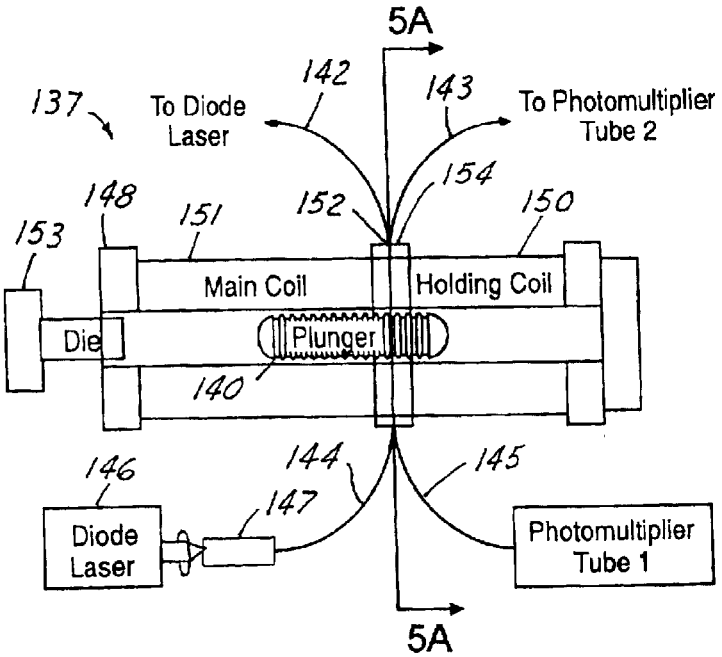
FIG. 5 illustrates the optical encoding and electronic control for a synchronized, multi-impact rivet gun in accordance with another embodiment of the present invention.
Figure 5A:
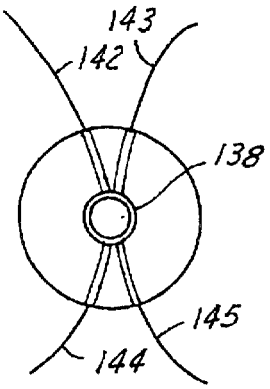
FIG. 5A illustrates the optical encoding and electronic control for the synchronized, multi-impact rivet gun of FIG. 5 in the direction of line A–A'.
Figure 6:
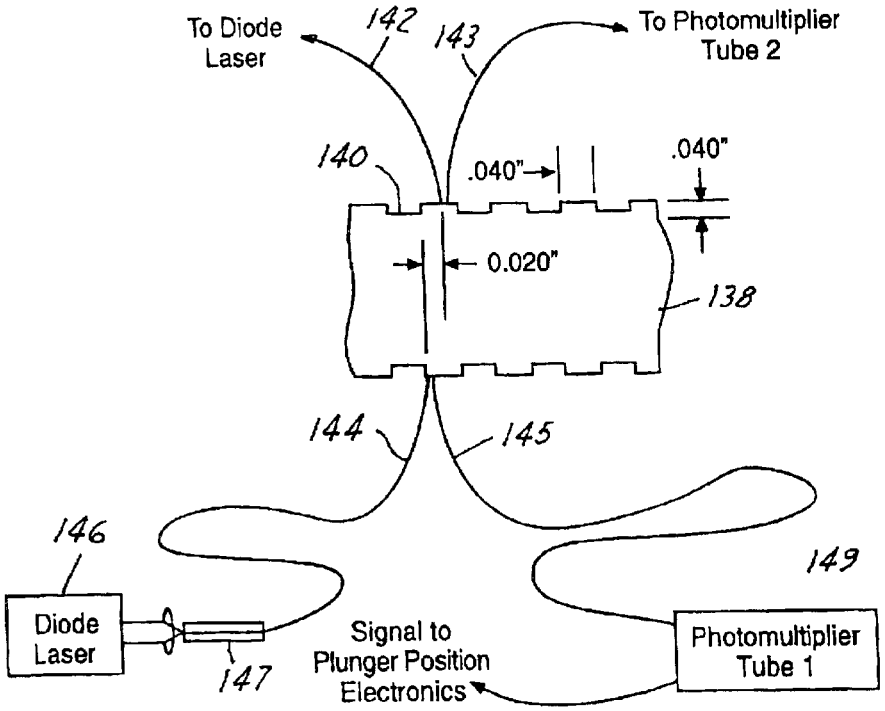
FIG. 6 illustrates a magnified sectional view of the plunger and fiber optics of FIG. 5.

Referring to FIGS. 5, 5A and 6, the optical encoding and electronic control 137 is illustrated. For the present embodiment, the plunger position and direction are determined using optical encoder techniques. The embodied plunger 138 includes equally spaced, concentric grooves 140 machined onto them 0.040" wide, 0.040" deep and separated by 0.040", as shown in FIG. 6. The measurements of the grooves 140 are an illustrative example of one possible groove dimension, as will be understood by one skilled in the art.

Optical fibers 142, 143, 144, 145 (i.e. optical sensors) illustrated as 1000 microns in diameter, both illuminate and collect scattered laser light from the plunger 138. The laser light is provided by an inexpensive diode laser 146 and is focused into the fiber 142, 143, 144, 145 with, for example, an X10 microscope objective. The optical fiber 145 is held with a commercial fiber chuck and fiber launcher 147 for precise and stable alignment. The laser light is guided to the rivet gun 148 through a first fiber 142. A second fiber 143 guides the collected light from the gun 148 to the optical detector and electronics (photomultiplier tube 149, PTM1, for the first rivet gun 148).

The gun end of the fibers 142, 143, 144, 145 access the gun 148 through holes 152 in the spacer 154 between the holding coil 150 and main coil 151 as shown in FIG. 5. The fiber ends are polished and placed within 1 mm of the plunger 138 to illuminate a small spot on the side of the plunger 138.

The receiver fiber 143, which is similar to optical fiber 142, collects the reflected light from the plunger 138, and another receiver fiber 145 guides this optical signal to a high-speed (Ins rise time) photomultiplier tube 149 (e.g. Hamamatsu Model #93 IB). There are two pairs of transmitting and receiving optical fibers 142, 144 and 143, 145, offset by 0.020" installed on each gun 148. On skilled in the art will realize that numerous other offsets may alternately be included. This arrangement of optical fibers generates a pair of substantially sinusoidal signals as the plunger 138 moves from the end plunger stop 151 to the die 153, with each peak and valley corresponding to 0.040" of plunger travel. One full period represents 0.080" of travel. The second set of transmitting and receiving fibers 143, 145 are offset by 0.020" and generate a quadrature signal, i.e. a signal phase shifted by ¼ of the groove period, relative to the first set of fibers 142, 144. These quadrature signals, when processed through a D-type flip flop integrated circuit, generate a logic signal having a level corresponding to plunger direction.

Referring again to FIG. 1, the waveform generators, 32, 33, 34, 35, 36 and 37 are programmed through a computer having a standard GPIB interface. The guns 12, 14 include the following major components: holding coils; main coils; magnetic plungers; rivet dies; and force sensors.

For basic operation, the holding coils pull the plungers backward to their rearmost position and a large current pulse of approximately 200 amperes is switched through the main coil. The magnetic plungers are pulled into the bore of the main coils and accelerate toward the dies. The dies transmit this impact force simultaneously into both ends of the rivet 22 to crush it. This process is repeated, for example, ten times within one second.

Figure 7A:
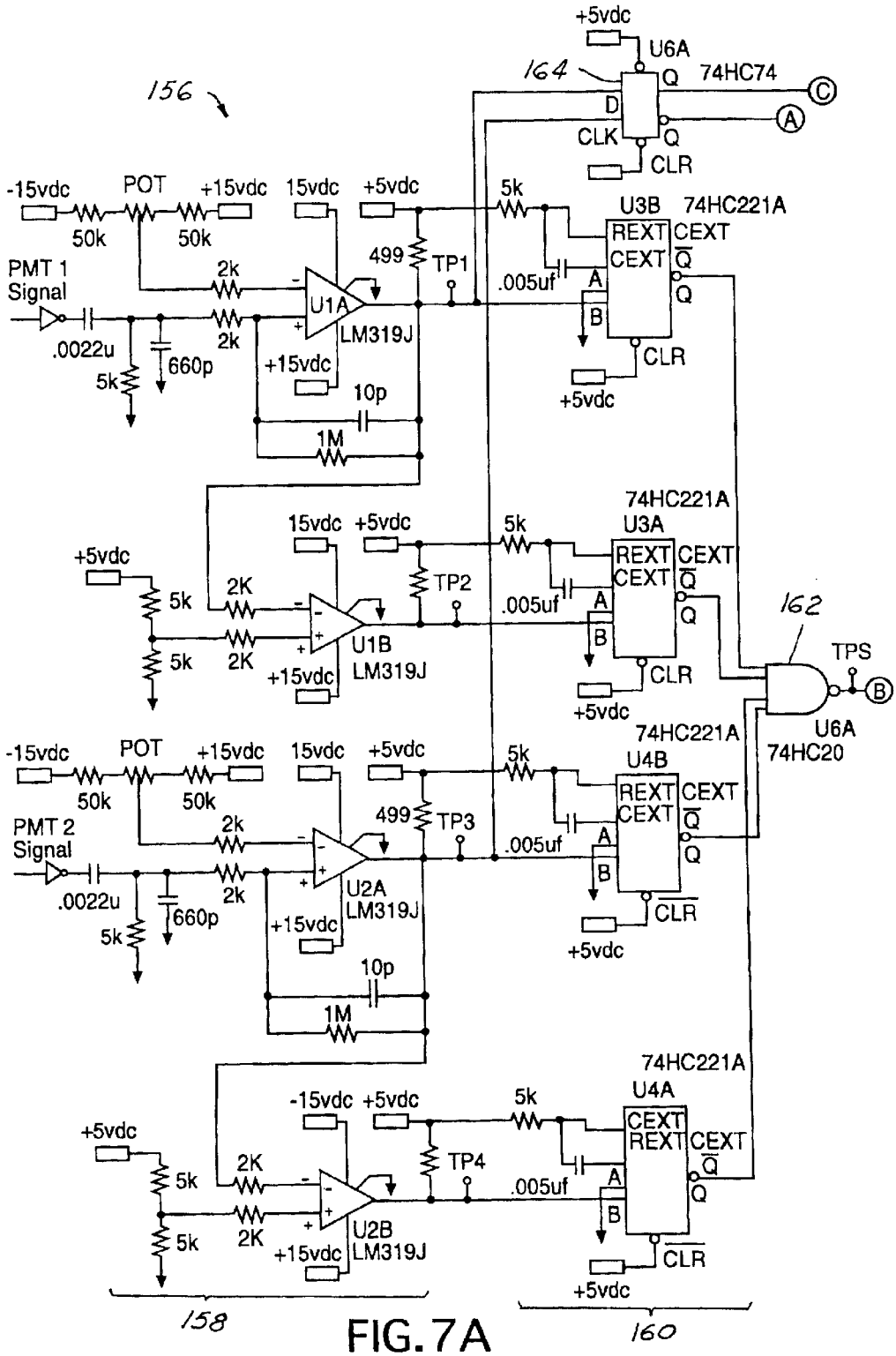
FIG. 7A illustrates the coil controller electronics for rivet gun coils in accordance with another embodiment of the present invention.
Figure 7B:
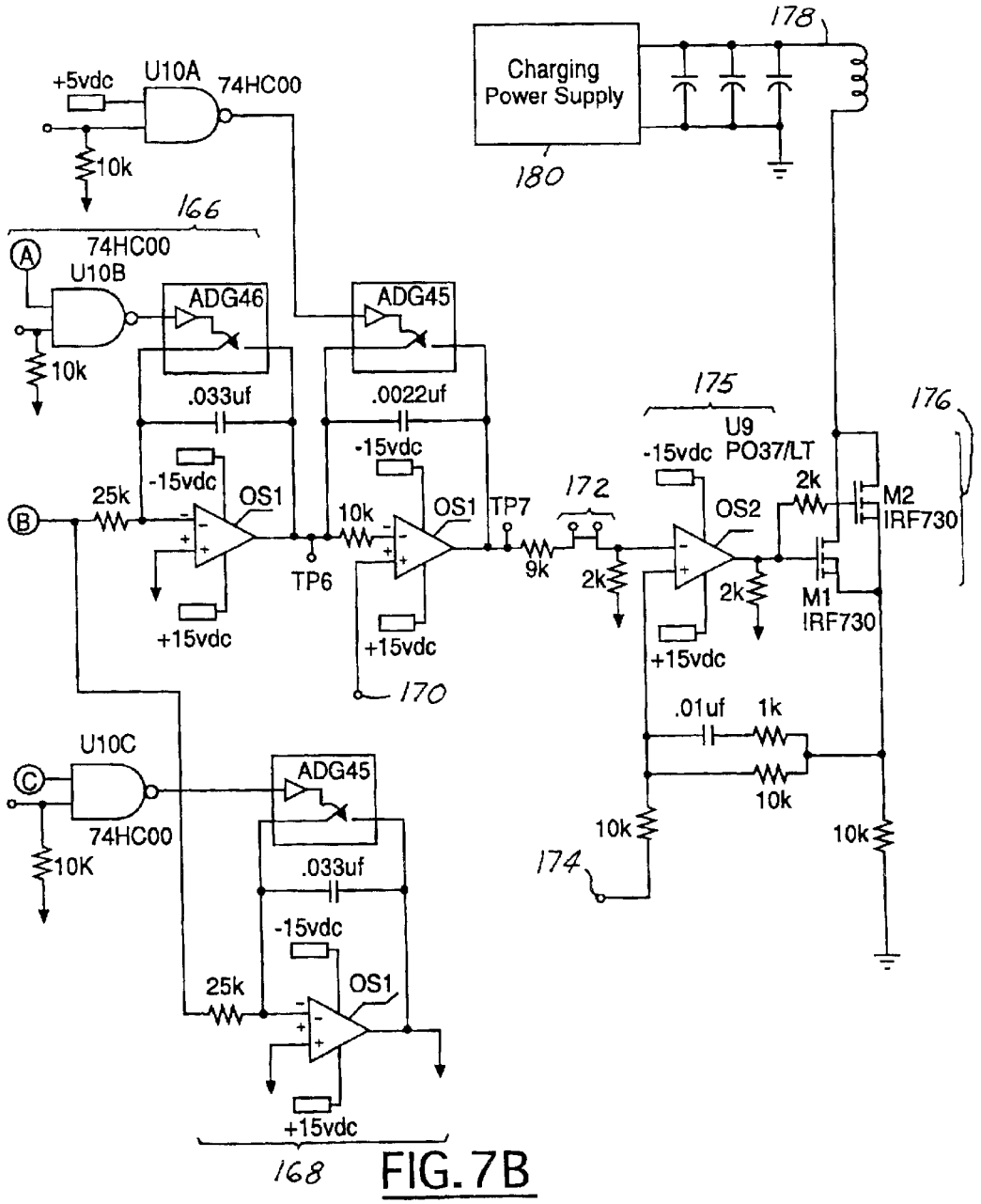
FIG. 7B illustrates the coil controller electronics for rivet gun coils in accordance with FIG. 7A.

The coil controller electronics 156 for each gun coil is illustrated in FIGS. 7A and 7B. The quadrature signals from the photomultiplier tubes PTM1 and PTM2 (see FIGS. 5 and 6) are processed by zero-crossing discriminators 158. These signals then trigger constant pulse width generators 160, which generate a pulse (here it is 15 microseconds long) for each zero crossing of the sinusoidal PMT signal. These pulses are combined in a pulse fan-in 162. A D-flip/flop 164 compares signals from the two photomultiplier tubes and generates plunger direction signals. The resultant forward and backward direction signals are used to gate the forward plunger position integrator 166 (receiving signal A from D-flip/flop 164) and backward plunger position integrator 168 (receiving signal B from pulse fan-in 162 and signal C from D-flip/flop 164). The plunger position vs. time is generated through integrating the charge in the 15 microsecond long pulses occurring during either the forward or backward direction gates. A pulse occurs for every 0.020" of plunger travel. Therefore either counting or integrating these pulses results in a voltage proportional to the plunger position.

The position vs. time comparator 169 generates the difference of the x(t) reference 170 and the forward integrator voltage to generate a plunger position error signal. The x(t) reference 170 is generated from the Position vs. Time Waveform Generator. The position error 172 is subtracted from the I(t) regulation 174 in comparator 175 to generate the control for the MOSFETs 176, which regulate the current through the gun coils 178, which are powered through a charging power supply 180. The I(t) regulation signal 174 is generated from the Current vs. Time Waveform Generators, as was discussed previously.

Figure 8:
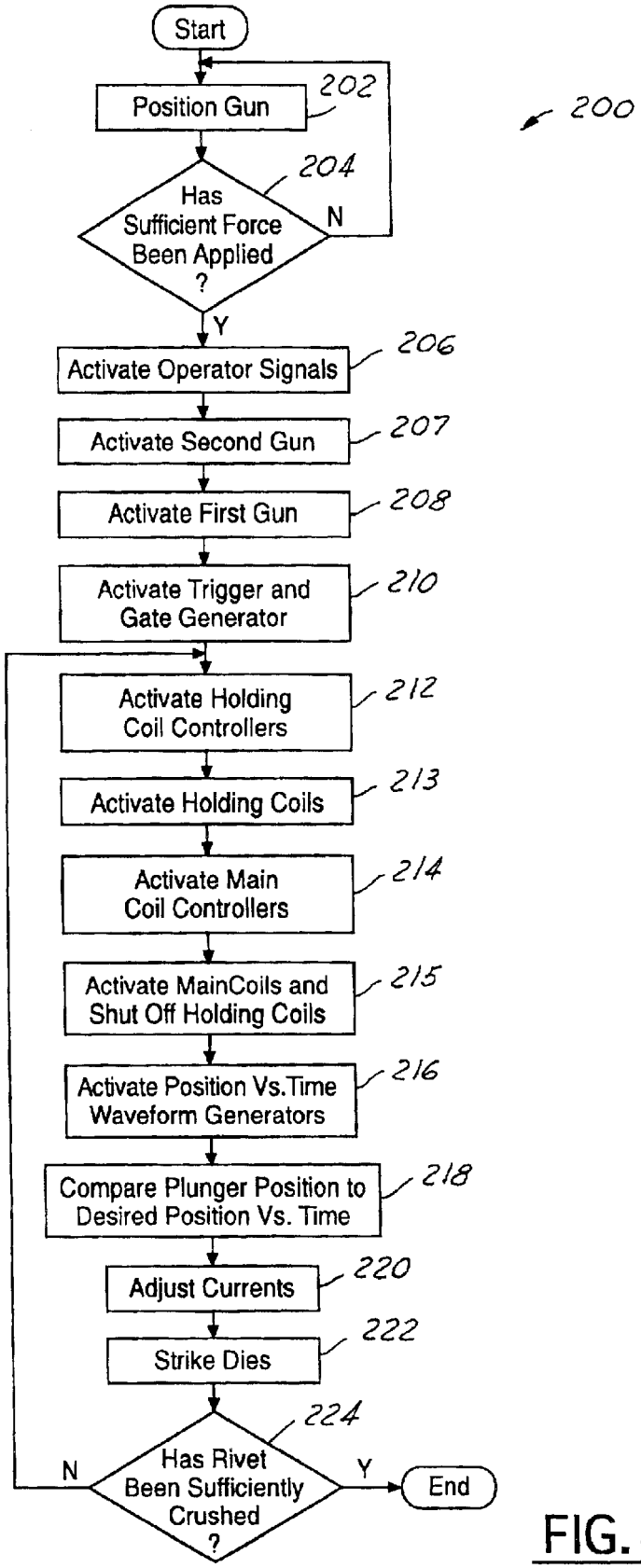
FIG. 8 illustrates a block diagram of a method for impacting a rivet, in accordance with another embodiment of the present invention.

Referring to FIG. 8, a block diagram 200 of a method for impacting a rivet, in accordance with a preferred embodiment of the present invention, is illustrated. Logic starts in operation block 202 where the first gun and the second gun are positioned against the head and tail of the rivet and pressure is applied to the respective dies.

In inquiry block 204, a check is made whether sufficient force has been applied. In other words, the force sensors send force signals to the Force Sensor Electronics, which determine if sufficient force has been applied to each gun. For a negative response, operation block 202 reactivates and additional pressure is applied to the guns.

Otherwise, the Force Sensor Electronics activate a first operator signal, e.g. change a first operator signal device (LED) from red to green on both guns, thereby signaling the operators that the guns are now enabled for operation.

In operation block 207, a second signal on both guns activates, e.g. changes from red to green, notifying the first gun operator that proper force is being applied and the second gun operator is ready to impact the rivet. When second gun operator sees that both guns are enabled, the second gun operator activates the second gun, e.g. depresses the second gun activation button.

In operation block 208, the first gun operator activates the first gun by depressing the first gun button. In response thereto, the Force Sensor Electronics, send an electrical trigger signal to the Trigger and Gate Generator.

In operation block 210, the Trigger and Gate Generator, sends a sequence of triggers and gates to the Holding Coil Current vs. Time Waveform Generators, the Position vs. Time Waveform Generators, and the Main Coil Current vs. Time Waveform Generators of both guns.

In operation block 212, the holding coil controller activates through the Trigger and Gate Generator, which triggers the Holding Coil Current vs. Time Waveform Generators, which send pre-programmed waveforms proportional to the desired holding coil current to the holding coil controllers.

In operation block 213, the holding coil controllers command the Holding Coil Power Supplies to supply the desired current to holding coils, and the plungers, begin to move back toward the holding coils.

In operation block 214, the Trigger and Gate Generator, sends triggers to Main Coil Waveform Generators, which send the desired main coil current programming to the Main Coil Controllers.

In operation block 215, the Main Coil Power Supplies provide short current pulses to the Main Coils, which brake the plungers by 'soft returning' them against the end stops. Holding Coil Waveform Generators turn off the Holding Coils, and the Main Coil Waveform Generators command approximately 4 ms long, high current pulses to the Main Coils, via the Main Coil Controllers and Main Coil Power Supplies.

In operation block 216, the Trigger and Gate Generator sends triggers to the Position vs. Time Waveform Generators, and the plungers begin accelerating toward the dies. Data from the Plunger Position Electronics is compared with the desired position vs. time from the Position vs. Time Waveform Generators in the Holding and Main Coil Controllers. The Holding and Main Coil Controllers adjust the Holding and Main Coil currents to minimize the difference between the desired and measured position vs. time of each plunger.

In operation block 220, currents to the coils are adjusted to generate the required plunger force.

In operation block 222, the plungers strike the dies, and the rivet is partially crushed.

In inquiry block 224, a check is made whether the rivet has been sufficiently crushed. Typically, a preset number of die strikes, e.g. 10, cycle through and the rivet is assumed crushed. For a negative response (or in the case of a preset number of strikes), operation block 212 reactivates.

From the foregoing, it can be seen that there has been brought to the art a new and improved rivet gun control system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims.

What is claimed is:

1. A rivet gun system comprising:

a first rivet gun comprising a rivet gun frame comprising a first end and a second end;

a die coupled to said second end;

a force sensor coupled to said rivet gun frame and adapted to detect a force applied to said die and adapted to generate a force signal in response to said force;

a holding coil defining a channel within said rivet gun frame, said holding coil adapted to generate a first electromagnetic force along said channel, said channel having a first end defined by an end stop and a second end defined by said die;

a main coil further defining said channel between said holding coil and said die, said main coil adapted to generate a second electromagnetic force along said channel;

a first plunger adapted to slide through said channel; and a force sensor electronics controller adapted to receive said force signal and further adapted to activate said holding coil and said main coil in response to said force signal above a threshold.

2. The rivet gun system of claim 1 wherein said force sensor electronics controller is further adapted to activate a second rivet gun comprising a second plunger, said second rivet gun is adapted to be synchronized with said first rivet gun in response to said force signal.

3. The rivet gun system of claim 2 further comprising at least one waveform generator adapted to generate a set position vs. time waveform, wherein said force sensor electronics controller further comprises a feedback control loop adapted to adjust a position vs. time of said first plunger to match said set position vs. time waveform in response to optical sensor data of said first plunger position and direction and said second plunger position and direction.

4. The rivet gun system of claim 1 further comprising a first LED adapted to activate in response to said force signal above said threshold.

5. The rivet gun system of claim 1 further comprising at least one optical sensor adapted to receive position and direction data of said plunger.

6. The rivet gun system of claim 1 wherein said force sensor electronics controller is adapted to activate a signal in response to said force signal below said threshold.

7. The rivet gun system of claim 1 wherein said main coil is adapted to brake said first plunger on a return stroke whereby said first plunger comes to rest against said end stop without significant impact vibration.

8. A method for riveting comprising:

applying a first force to a first side of a compressible object from a first rivet gun;

aligning a second rivet gun with said first rivet gun on a second side of said compressible object;

applying a second force from said second rivet gun to said second side;

signaling that said first force and said second force are adequate;

signaling said first rivet gun that said second rivet gun is activated;

triggering said first rivet gun;

synchronizing said first rivet gun and said second rivet gun; and impacting said compressible object.

9. The method of claim 8 wherein signaling that said first force and said second force are adequate further comprises signaling that said first force and said second force are adequate through activating at least one of an LED or alternate audio or visual signal device.

10. The method of claim 8 wherein synchronizing said first rivet gun and said second rivet gun further comprises detecting a first plunger position and direction in said first rivet gun; and detecting a second plunger position and direction in said second rivet gun.

11. The method of claim 10 wherein synchronizing said first rivet gun and said second rivet gun further comprises comparing a position vs. time of a first plunger within said first rivet gun with a set position vs. time waveform in response to optical sensor data of said first plunger position and direction and said second plunger position and direction.

12. The method of claim 8 further comprising receive position and direction data of a plunger within said first rivet gun with at least one optical sensor.

13. The method of claim 8 further comprising braking a first plunger with a main coil within said rivet gun on a return stroke whereby said first plunger comes to rest against a end stop without significant impact vibration.

14. A rivet gun system comprising:

a first rivet gun comprising a first die, said first rivet gun further comprising a first force sensor adapted to detect a first force applied to said first die, said first rivet gun further comprising a first operator signal device;

a second rivet gun comprising a second die, said second rivet gun further comprising a second force sensor adapted to detect a second force applied to said second die, said second rivet gun further comprising a second operator signal device; and a force sensor electronics controller adapted to receive said first force signal and said second force signal, said first force sensor electronics controller adapted to activate said first operator signal device and said second operator signal device in response to said first force signal and said second force signal above a sufficient operational force threshold.

15. The rivet gun system of claim 14 wherein said force sensor electronics controller is further adapted to activate a second rivet gun comprising a second plunger, said second rivet gun is adapted to be synchronized with said first rivet gun in response to said force signal.

16. The rivet gun system of claim 15 further comprising at least one waveform generator adapted to generate a set position vs. time waveform, wherein said force sensor electronics controller further comprises a feedback control loop adapted to adjust a position vs. time of said first plunger to match said set position vs. time waveform in response to optical sensor data of said first plunger position and direction and said second plunger position and direction.

17. The rivet gun system of claim 14 further comprising a first LED adapted to activate in response to said force signal above said threshold.

18. The rivet gun system of claim 14 further comprising at least one optical sensor adapted to receive position and direction data of said plunger.

19. The rivet gun system of claim 14 wherein said force sensor electronics controller is adapted to activate a signal in response to said force signal below said threshold.

20. The rivet gun system of claim 14 wherein said main coil is adapted to brake said first plunger on a return stroke whereby said first plunger comes to rest against said end stop without significant impact vibration.

* * * * *